US007250243B2

(12) United States Patent
Lee et al.

(10) Patent No.: US 7,250,243 B2
(45) Date of Patent: Jul. 31, 2007

(54) NONMAGNETIC ONE-COMPONENT TONER FOR ELECTROPHOTOGRAPHIC IMAGE FORMING APPARATUS

(75) Inventors: Duck-hee Lee, Seoul (KR); Jong-moon Eun, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 303 days.

(21) Appl. No.: 10/843,394

(22) Filed: May 12, 2004

(65) Prior Publication Data

US 2004/0229145 A1 Nov. 18, 2004

(30) Foreign Application Priority Data

May 17, 2003 (KR) ..... 10-2003-0031421

(51) Int. Cl.
*G03G 9/08* (2006.01)

(52) U.S. Cl. ..... 430/108.6; 430/108.7; 430/108.8; 430/109.4

(58) Field of Classification Search ..... 430/108.6, 430/108.7, 108.9, 108.23, 109.4
See application file for complete search history.

(56) References Cited

U.S. PATENT DOCUMENTS 6,087,059 A * 7/2000 Duggan et al. ..... 430/108.22
6,338,929 B1 * 1/2002 Hagi et al. ..... 430/108.4
2002/0064722 A1 5/2002 Endo et al.
2003/0044705 A1 * 3/2003 Sano et al. ..... 430/106.2
2003/0157419 A1 * 8/2003 Miyakawa et al. ..... 430/108.6

FOREIGN PATENT DOCUMENTS

| | | |
|---|---|---|
| JP | 60-136755 | 7/1985 |
| JP | 61250658 | 11/1986 |
| JP | 2000122336 | 4/2000 |
| JP | 2002-122336 | 4/2002 |
| JP | 2002-287413 | 10/2002 |
| JP | 2003-91103 | 3/2003 |
| KR | 10-2001-0002581 | 1/2001 |
| KR | 1020020061682 A | 7/2002 |

OTHER PUBLICATIONS

Korean Office Action dated Feb. 25, 2005 of the Korean Patent Application No. 10-2003-0031421.

* cited by examiner

*Primary Examiner*—John L Goodrow
(74) *Attorney, Agent, or Firm*—Staas & Halsey LLP

(57) ABSTRACT

A nonmagentic one-component toner for an electrophotographic image forming apparatus includes a toner with toner particles, a binder resin having a coloring agent, a charging control agent, and a release agent, and an external additive added to the toner particles. The external additive includes approximately 0.1 to 3.0 wt % of silica having a charge opposite to the toner particles, approximately 0.1 to 3.0 wt % of silica having a same charge as the toner particles, and approximately 0.1 to 4.0 wt % of titanium dioxide.

17 Claims, 1 Drawing Sheet

NONMAGNETIC ONE-COMPONENT TONER FOR ELECTROPHOTOGRAPHIC IMAGE FORMING APPARATUS

CROSS-REFERENCE TO RELATED APPLICATIONS

This application claims the priority of Korean Patent Application No. 2003-31421, filed on May 17, 2003, in the Korean Intellectual Property Office, the disclosure of which is incorporated herein in its entirety by reference.

BACKGROUND OF THE INVENTION

1. Field of the Invention

The present invention relates to a toner for an electrophotographic image forming apparatus, and more particularly, to a nonmagnetic one-component toner used to develop an electrostatic latent image formed on the surface of a photosensitive medium for an electrophotographic image forming apparatus.

2. Description of the Related Art

In general, an electrophotographic image forming apparatus, such as a copier, a laser printer or a facsimile, forms an electrostatic latent image on a photosensitive medium, such as a photosensitive drum or a photosensitive belt, develops the electrostatic latent image with a developing agent having a predetermined color, and transfers the developed electrostatic latent image onto a sheet of paper, thus obtaining a desired image.

There are two types of electrophotographic image forming apparatuses, such as a dry-type electrophotographic image forming apparatus and a wet-type electrophotographic image forming apparatus, depending on a developing agent. In the dry-type electrophotographic image forming apparatus, a powder state of toner is used as the developing agent, and in the wet-type electrophotographic image forming apparatus, a liquid developing agent in which a toner that is mixed with a liquid carrier is used as the developing agent.

Dry-type developing methods using the powder state of toner include a two-component developing method using a two-component toner in which carrier particles used to transport toner particles are contained, and a one-component developing method using only toner without a carrier. The one-component developing method includes a magnetic one-component developing method and a nonmagnetic one-component developing method. In the magnetic one-component developing method, a developing operation is performed using a toner for the magnetic one-component development. In the nonmagnetic one-component developing method, a toner layer is formed on a developing roller using a toner for the nonmagnetic one-component development and is developed either in contact with not in contact with a photosensitive medium.

In the contact-type nonmagnetic one-component developing method, the price is very competitive. However, since it is difficult to attain dot reproducibility, line reproducibility, and high-resolution implementation, it is not easy to obtain a high quality image. Meanwhile, in the noncontact-type nonmagnetic one-component developing method, the structure of a developing unit is simple, and thus may be minimized. In addition, since attaining color reproducibility, edge reproducibility, high tone gradation, and high-resolution implementation is facilitated, a high quality image may be obtained.

FIG. 1 schematically illustrates a noncontact-type developing unit for a conventional electrophotographic image forming apparatus. Referring to FIG. 1, the conventional electrophotographic image forming apparatus includes a photosensitive medium 10, a charging roller 12, a laser scanning unit (LSU) 14, a developing roller 16, a toner supplying roller 18, and a toner layer regulation unit 20.

The photosensitive medium 10 has a structure in which a photosensitive film formed of a photosensitive material is formed on the circumference of a metallic drum. The surface of the photosensitive medium 10 is charged by the charging roller 12 to a predetermined potential, and an electrostatic latent image is formed on the surface of the charged photosensitive medium 10 by light irradiated from the LSU 14.

Toner 30 stored in a toner storage space 32 is supplied by the toner supplying roller 18 to the surface of the developing roller 16. The toner 30 supplied to the surface of the developing roller 16 becomes a thin film having a uniform thickness using the toner layer regulation unit 20. Simultaneously, the toner 30 is rubbed by the developing roller 16 and the toner layer regulation unit 20 and is charged with a predetermined charge. In this case, M/A (mg/cm$^2$) and Q/M (μC/g) of the toner 30 are regulated by the toner layer regulation unit 20. Here, M/A (mg/cm$^2$) is the weight of the toner 30 per unit area measured on the developing roller 16 after going through the toner layer regulation unit 20, and Q/M (μC/g) is an amount of charge of the toner 30 per unit weight measured on the developing roller 16 after going through the toner layer regulation unit 20.

As described above, the toner 30, which is charged with a predetermined charge and in which M/A (mg/cm$^2$) and Q/M (μC/g) are regulated, moves to the surface of the photosensitive medium 10 using the developing roller 16 that is spaced a predetermined gap apart from the photosensitive medium 10 and rotated. In this case, the movement of the toner 30 is performed by a potential difference between the developing roller 16 and the electrostatic latent image formed on the surface of the photosensitive medium 10. The toner 30 that moves to the surface of the photosensitive medium 10 is attached to the electrostatic latent image. As such, the electrostatic latent image is developed as a desired image.

The image developed on the surface of the photosensitive medium 10 is transferred onto a sheet of paper by a transfer roller (not shown), and then is fused on the sheet of paper by a fusing unit (not shown). Toner remaining on the surface of the photosensitive medium 10 after the image is transferred onto the sheet of paper is removed by a cleaning blade 22 and is stored in a waste toner storage space 34.

Nonmagnetic one-component polymerization and pulverization-type toner used in the above-described conventional noncontact-type developing method includes toner particles in which a coloring agent, a charging control agent (CCA), and a release agent are added uniformly into a binder resin to improve chromaticity, charging characteristics, and fusing properties, and a variety of types of external additives added to toner particles to provide the fluidity, the charging stability, and the cleaning properties of toner.

In the noncontact-type nonmagnetic one-component developing method, to maintain stable developing properties, prevent contamination (fog or background) on a non-image portion, and prevent the scattering of toner, the charging amount of toner should be maintained uniformly, and the distribution of the charging amount of the toner should be maintained uniformly both at an initial developing stage and after a long-term image printing operation. In this way, to provide uniform charging properties to toner, toner should be formed to a small thickness on a developing roller. However, when a toner layer is formed to a thin film on the developing roller, the toner may easily deteriorate due to a large amount of stress, or may be easily fused on a toner regulation unit. In addition, when the toner layer is formed to a small thickness on the developing roller, a developing efficiency may be rapidly lowered due to an increase in a toner charging amount, and the concentration of an image may be thereby lowered. When the toner charging amount is reduced to improve the developing efficiency, an increase in contamination (fog) on the nonimage portion and contamination caused by the scattering of toner occur.

Accordingly, in the noncontact-type nonmagnetic one-component developing method, the charging amount of the toner should be maintained uniformly, and the distribution of the charging amount of the toner should be maintained uniformly so that the occurrence of contamination (fog) on the nonimage portion is prevented, and excellent developing properties are maintained even after the long-term image printing operation. This has a close relation to the type and composition of an external additive added to toner particles.

For example, Japanese Patent Laid-Open Publication No. 2000-122336 discloses a two-component negative charge type toner in which two or more external additives which are at least positive charge type inorganic particles of 80-800 nm number average diameter and negative charge type inorganic particles of 5-50 nm number average diameter, where the weight ratio of the positive charge type inorganic particles to the negative charge type inorganic particles is in a range of 2.5:7.5 to 7.5:2.5, are mixed with a carrier. In addition, Korean Patent Laid-Open Publication No. 2002-061682 discloses a nonmagnetic one-component toner composition in which an external additive including hydrophobic silica having a specific surface area of 20-80 $m^2/g$, hydrophobic silica having a specific surface area of 130-230 $m^2/g$, and titanium oxide having an average diameter of 100-500 nm is added to the surface of toner particles.

In the related art, to grant fluidity to the toner, prevent an increase in a toner charging amount, and remove a low electrical resistance material, such as remaining toner, fat or ozone adducts attached to a photosensitive medium and a toner layer regulation unit, as described above, silica particles and two or three types of inorganic fine particles are used as external additives. The inorganic fine particles are effective as an abrasive to provide a cleaning effect, an initial toner charging property, and fluidity. However, after long-term use, the improvement in charging stability and in the transfer property of the toner are not sufficient. In addition, even though the size of the inorganic particles is very small, the inorganic particles easily cohere to one another. Thus, it is easy to form a cohesive substance having the size of the coarse particles of several tens of μm, and it is difficult to attach the cohesive substance onto the surface of the toner particles electrostatically. Thus, a larger energy is needed to attach the inorganic particles that are joined together onto the surface of the toner particles. In this case, the inorganic particles are easily buried under the surface of the toner particles. Meanwhile, when the inorganic particles do not stick sufficiently to the surface of the toner particles, the inorganic particles separate from the toner particles and are accumulated in the toner stored in a developing unit, and due to white coarse particles formed of inorganic fine particles that are joined together, a white point appears on a printed image after a developing or fusing operation. In particular, when only hydrophobic titanium dioxide $TiO_2$ ultrafine particles are added as an external additive together with silica, image defects, such as offset and line burst, occur, and the characteristic of prevention of contamination (fog) on the nonimage portion is lowered after a long-term operation.

Meanwhile, positive charge type polymer beads may be added so that the charging stability of the toner and the uniform distribution of a toner charging amount are maintained for a long time. However, since the polymer beads have the size of coarse particles, unlike silica particles having a size equal to or less than 50 nm, the polymer beads easily separate from the toner particles. In particular, the polymer beads attached to the photosensitive medium are not easily cleaned due to a spherical shape. As such, the polymer beads remaining on the photosensitive medium are attached and accumulated to a charging roller, causing contamination of the charging roller and image contamination.

SUMMARY OF THE INVENTION

The present invention provides a nonmagnetic one-component toner in which the type, charge, and content of an external additive are adjusted such that stable maintenance of a toner charging amount, the uniform distribution of the toner charging amount, and a high fluidity and a developing property are maintained for a long time.

According to an aspect of the present invention, a nonmagnetic one-component toner for an electrophotographic image forming apparatus includes the toner comprising toner particles where a coloring agent, a charging control agent, and a release agent are contained in a binder resin, and an external additive added to the toner particles, wherein the external additive includes 0.1 to 3.0 wt % of silica having a charge opposite to the toner particles, 0.1 to 3.0 wt % of silica having the same charge as the toner particles, and 0.1 to 4.0 wt % of titanium dioxide.

Silica having a charge opposite to the toner particles may be large silica having an average particle size of 30-200 nm, and silica having the same charge as the toner particles may be small silica having an average particle size of 5-20 nm.

The external additive may further include 0.1-3.0 wt % of large silica having the same charge as the toner particles and having an average particle size of 30-200 nm.

The weight ratio of the large silica to the small silica may range from 0.5:1 to 3:1. The weight ratio of silica having the same charge as the toner particles to silica having a charge opposite to the toner particles of the large silica may range from 0:1 to 6:1.

Titanium dioxide may include 0.1-2.0 wt % of hydrophobic titanium dioxide and 0.1-2.0 wt % of conductive titanium dioxide.

In this case, resistance of hydrophobic titanium dioxide may be $10^5$-$10^{12}$ Ωcm, and the resistance of conductive titanium dioxide may range from 1 to $10^5$ Ωcm.

An average particle size of hydrophobic titanium dioxide may be 5-50 nm, and an average particle size of conductive titanium dioxide may be 30-500 nm.

A charging amount per weight (Q/M) may be an absolute value 5-30 μC/g, and an acid value of the binder resin may be 3-12 mg KOH/g.

Additional aspects and/or advantages of the invention will be set forth in part in the description which follows and, in part, will be obvious from the description, or may be learned by practice of the invention.

BRIEF DESCRIPTION OF THE DRAWING

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
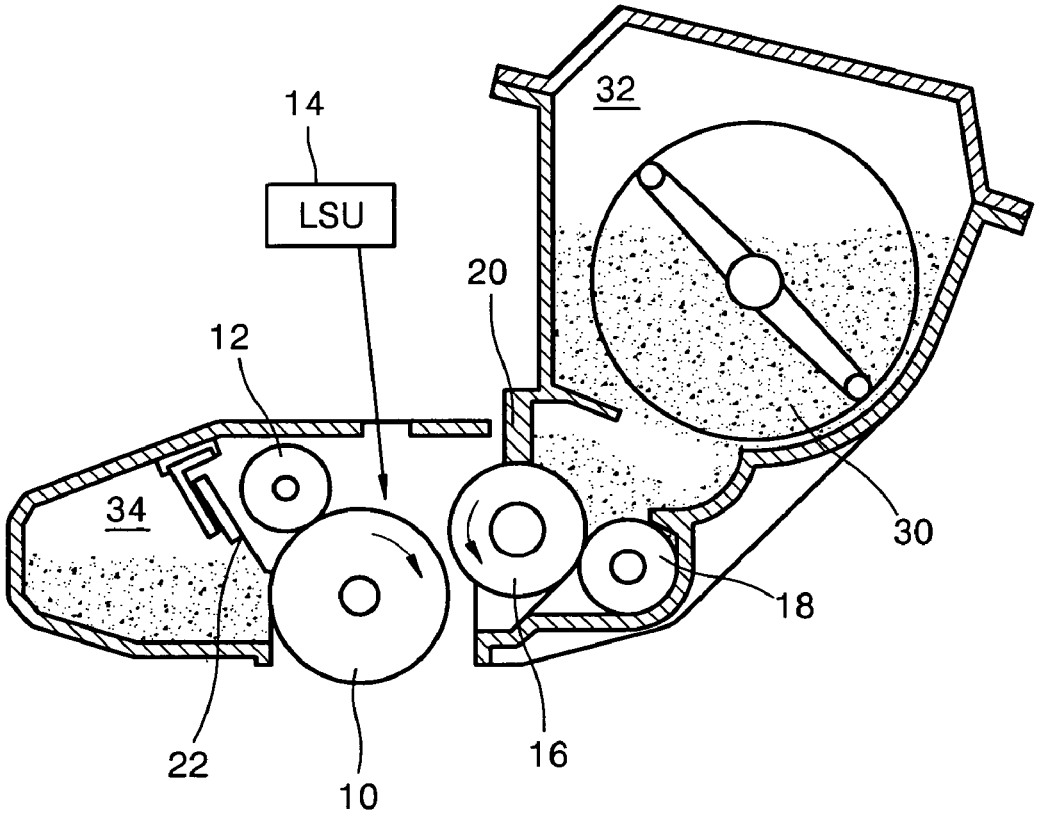
FIG. 1 (PRIOR ART)
FIG. 1 schematically illustrates a noncontact-type developing unit for a conventional electrophotographic image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, a nonmagnetic one-component toner for an electrophotographic image forming apparatus according to an embodiment of the present invention will be described in detail.

Nonmagnetic one-component toner according to the present invention includes toner particles wherein a coloring agent, a charging control agent (CCA), and a release agent are contained in a binder resin, and an external additive is added to the toner particles.

The binder resin is contained in an amount of about 70-95 wt % in the toner particles. A resin, such as polystyrene, polyester or epoxy, may be used as the binder resin. In addition, a variety of types of well-known resins may be used as the binder resin. A polyester resin has an excellent fusing property and transparency and is suitable for a color developing agent.

The properties of toner according to the present invention are also affected by an acid value of the binder resin. As the acid value becomes larger, a possibility that toner is attached to a toner regulation unit, for example, a blade, is high. Thus, preferably, the acid value is small. Specifically, the acid value of the binder resin is generally between approximately 3 and 12 mg KOH/g, inclusive. If the acid value is less than approximately 3 mg KOH/g, a charging performance of toner may be lowered. If the acid value exceeds approximately 12 mg KOH/g, the stability of a toner charging amount with a change of humidity may be adversely affected, and a possibility that the toner is attached to the blade may be high.

Carbon black, aniline black, aniline blue, charcoal blue, chromium yellow, ultramarine blue, duPont oil red, quinoline yellow, methylene blue chloride, phthalocyanine blue, malachite green oxalate, lamp black, rose Bengal, rhodamine dyes or pigment, anthraquinone dyes, monoazo and bisazo dyes or quinachridone magenta dyes may be used as the coloring agent.

When the coloring agent is carbon black, generally, a primary particle size is 15-70 nm, in particular, 20-55 nm, and a specific surface area is equal to or less than 200 $m^2/g$. When carbon black is used in melting and blending, dispersability and pulverizability of the coloring agent with other components are effective.

The coloring agent may be used in a sufficient amount for a coloring toner forming a visible image through development, for example, generally, 0.5-10 wt %, more generally, 0.5-8 wt %, and most generally, 1-5 wt % of the toner particles. If the content of the coloring agent is less than approximately 0.5 wt %, a coloring effect may be insufficient. If the content of the coloring agent exceeds approximately 10 wt %, the density of an image is saturated, and the developing performance of toner is lowered. For example, the electrical resistance of the toner is reduced such that a sufficient triboelectric charging amount of the toner is not obtained, and contamination occurs.

The charging control agent (CCA) and the release agent, such as wax, may be uniformly dispersed in the binder resin, to improve a charging characteristic and a fusing property of the toner.

The toner is required to be stably fixed on a developing roller by an electrostatic force. The electrostatic force of the toner is generated by a toner layer regulation unit. Thus, a stable and fast charging speed is required. Thus, the CCA is needed for the charging stability of the toner.

Azo dyes containing chromium or salicylic acid compounds containing metals, such as chromium, iron, and zinc may be used as the CCA, for example, a traditional negatively charged type CCA. In addition, a variety of types of well-known materials may be used as the CCA.

Generally, the CCA may be used in an amount of approximately 0.1-10 wt %. If the content of the CCA is less than approximately 0.1 wt %, an adding effect may not be obtained. If the content of the CCA exceeds approximately 10 wt %, the charging instability of the toner may occur.

Generally, by adding the CCA, the toner has a charging amount per weight (Q/M) of about −5--30 μC/g. Meanwhile, generally, if the toner has a positive charge type, the charging amount per weight (Q/M) is 5-30 μC/g.

Recently, a low temperature fusing property of toner has been required to achieve aspects, such as low energizing or reduction in a warm-up time. Thus, the use of a release agent, such as wax having an excellent fusing property at a wide temperature range, is required.

Low molecular weight polypropylene wax, low molecular weight polyethylene wax, ester wax, paraffin wax, higher fatty acid or fatty acid amide may be used as the release agent. Generally, the release agent may be used in an amount of approximately 0.1-10 wt %. If the content of the release agent is less than approximately 0.1 wt %, an adding effect may not be obtained. If the content of the release agent exceeds approximately 10 wt %, offset defects, lowering of fluidity or caking occurs.

Methods of adding the CCA or the release agent to the toner include a method of dispersing the CCA or the release agent in the toner particles and a method of attaching the CCA or the release agent to the surface of the toner particles. The method of dispersing the CCA or the release agent in the toner particles is widely used. In addition, a higher fatty acid and metallic salt thereof may be added in an appropriate amount, to protect a photosensitive medium, prevent the deterioration of a developing characteristic, and obtain a high quality image.

The features of the toner according to an embodiment of the present invention include that a portion of the silica have a charge opposite to the toner particles, a portion of the silica have the same charge as the toner particles, and the titanium dioxide is added as an external additive.

The toner particles may be negative charge type toner particles or positive charge type toner particles, depending on an added charge control agent (CCA). For example, if the toner particles have a negative charge type, a positive charge type silica is used as the silica having a charge opposite to the toner particles, and a negative charge type silica is used as the silica having the same charge as the toner particles. Conversely, if the toner particles have a positive charge type, a negative charge type silica is used as the silica having a charge opposite to the toner particles, and a positive charge type silica is used as the silica having the same charge as the toner particles.

Hereinafter, the negative charge type toner particles will be described.

In the present invention, the silica generally have a charge opposite to the toner particles, that is, the positive charge type silica is large silica having a larger diameter, and the silica having the same charge as the toner particles, that is, the negative charge type silica is small silica having a smaller diameter.

A main role of the large silica as spacer particles is to prevent the deterioration of the toner and improve a transfer property of the toner. In particular, if the large silica has a charge opposite to the toner particles, that is, a positive charge type, negative charge generated by triboelectric charging is collected to the negative charge type toner particles, and positive charge is collected to the positive charge type large silica, thus forming a balance such that a more stable charging amount is applied to the toner particles.

A main role of the small silica to grant fluidity to the toner. In particular, when the diameter has the same charge as the toner particles, a negative charge type, a sufficient charging amount is easily applied to the toner particles. In other words, the negative charge type small silica serves to reinforce a negative charging property of the toner particles.

As the amount of the positive charge type large silica is increased, M/A (mg/cm$^2$) is reduced, but the fluidity of the toner is lowered. As the amount of the negative charge type small silica is increased, M/A (mg/cm$^2$) is increased, but the fusing property of the toner is lowered. M/A (mg/cm$^2$) is the weight of toner per unit area measured on a developing roller after going through a toner layer regulation unit. M/A should be maintained at a low level such that contamination (fog) and dispersion of toner are prevented. Thus, a toner layer is formed to a small thickness to have a M/A of 0.3-1.0 mg/cm$^2$. Thus, diameters, a content, and a combination ratio of large silica and small silica should be adjusted in an optimum state, to improve the performance of the toner.

The positive charge type large silica and the negative charge type small silica may be obtained by processing the surface of each of the silica particles with a well-known positive charge type or negative charge type surface processing agent.

Generally, the positive charge type large silica may be used in an amount of approximately 0.1-3.0 wt % of the toner particles. If the content of the positive charge type large silica is less than approximately 0.1 wt %, the positive charge type large silica does not serve as spacer particles. If the content of the positive charge type large silica exceeds approximately 3.0 wt %, the positive charge type large silica may be separated from the toner or may damage the surface of the photosensitive medium, and the resolution of an image may be lowered.

Generally, the negative charge type small silica may be used in an amount of approximately 0.1-3.0 wt % of the toner particles. If the content of the negative charge type small silica is less than approximately 0.1 wt %, a possibility that the fluidity of the toner is lowered is high. If the content of the negative charge type small silica exceeds approximately 3.0 wt %, the fusing property of the toner may be lowered, and an overcharging amount of the toner may occur.

Generally, the positive charge type large silica has an average particle size of approximately 30-200 nm, more generally, 30-150 nm.

If the positive charge type large silica has an average particle size less than approximately 30 nm, the positive charge type large silica is easily buried in the toner particles and does not serve as spacer particles. If the positive charge type large silica has an average particle size over approximately 200 nm, the positive charge type large silica is not attached to the toner particles and is easily separated from the toner particles and does not serve as the spacer particles.

Generally, the negative charge type small silica has an average particle size of approximately 5-20 nm, more generally, 7-16 nm.

If the negative charge type small silica has an average particle size less than approximately 5 nm, the negative charge type small silica is easily buried under the fine and uneven surface of the toner particles, and it is not easy to adjust the charging property and fluidity of the toner. If the negative charge type small silica has an average particle size over approximately 20 nm, the fluidity of the toner is not sufficiently improved.

The external additive may further include silica having the same charge as the toner particles, that is, a negative charge type large silica. Generally, the negative charge type large silica has an average particle size of approximately 30-200 nm and may be added in an amount of approximately 0.1-3.0 wt % of the toner particles.

The combination ratio of the large silica and the small silica may be varied depending on a developing system. However, in the present invention, generally, the weight ratio of the positive charge type and negative charge type large silica to the negative charge type small silica (large silica: small silica) ranges from approximately 0.5:1 to 3:1.

If there is so much small silica exceeding the above range compared to the large silica, the toner layer becomes thicker, the charging amount of the toner is lowered, and the fusing property of the toner decreases. If there is so much large silica exceeding the above range compared to the small silica, the fluidity of the toner decreases.

Generally, the weight ratio of the negative charge type silica to the positive charge type silica of the large silica (negative charge type large silica: positive charge type large silica) ranges from approximately 0:1 to 6:1. The negative charge type large silica may not be externally added. However, if the negative charge type large silica is externally added, generally, the negative charge type large silica is not added to exceed the above range compared to the positive charge type large silica. If the negative charge type large silica is added in excess and the positive charge type large silica is reduced too much, the above-described adding effect of the positive charge type large silica cannot be obtained.

The toner according to an embodiment of the present invention as an external additive includes titanium dioxide in addition to the above-described two or three types of silica. The main aspect of adding titanium dioxide is to improve charging stability and fluidity of the toner.

One of hydrophobic titanium dioxide and conductive titanium dioxide may be used as the titanium dioxide added. However, generally, hydrophobic titanium dioxide and conductive titanium dioxide may be used together as the titanium dioxide added. Hydrophobic titanium dioxide contributes to the fluidity of the toner. However, when only hydrophobic titanium dioxide is used as the titanium dioxide added, the lowering of a charging performance of the toner caused by long-term use and contamination, such as dispersion of the toner thereof, occurs easily. Thus, generally, hydrophobic titanium dioxide and conductive titanium dioxide may be used together as the titanium dioxide added. Since the conductive titanium dioxide contributes to a charging stability of the toner during long-term use of the toner, the lowering of the charging performance of the toner caused by long-term use and nonuniform charging distribution may be prevented.

As in the above-described silica, the resistance, the average particle size, and the content of each of conductive titanium dioxide and hydrophobic titanium dioxide may be important in showing the above-described effect.

Conductive titanium dioxide may have the resistance of approximately $1\text{-}10^5$ cm, generally, approximately $1\text{-}10^4$ Ωcm, more generally, approximately $4\text{-}10^3$ Ωcm. Hydrophobic titanium dioxide may have the resistance of approximately $10^5\text{-}10^{12}$ Ωcm, generally, approximately $10^5\text{-}10^{11}$ Ωcm, more generally, approximately $10^7\text{-}10^{10}$ Ωcm.

Fine particles have a large cohesion between particles, and thus are surface-processed with organic materials. This organic processing allows the fine particles to have a high resistance and a hydrophobic property. Meanwhile, the fine particles are surface-processed with inorganic materials, ane the fine particles have a conductive low resistance.

Generally, the conductive titanium dioxide particles have an average particle size of approximately 30-500 nm, more generally, approximately 40-300 nm. The hydrophobic titanium dioxide particles have an average particle size of approximately 5-50 nm, more generally, approximately 15-40 nm.

If the average particle size of the conductive titanium dioxide is less than approximately 30 nm, the charging performance of toner is lowered. If the average particle size of the conductive titanium dioxide exceeds approximately 500 nm, the charging stability of the toner is lowered. If the average particle size of the hydrophobic titanium dioxide is less than approximately 5 nm, the charging performance of toner is lowered. If the average particle size of the hydrophobic titanium dioxide exceeds approximately 50 nm, the fluidity of the toner is lowered.

Generally, the conductive titanium dioxide may be used in an amount of approximately 0.1-2.0 wt % of the toner particles, and the hydrophobic titanium dioxide may be used in an amount of approximately 0.1-2.0 wt % of the toner particles. When the conductive titanium dioxide and the hydrophobic titanium dioxide are used as the titanium dioxide added, the titanium dioxide may be used in an amount of approximately 0.1-4.0 wt % of the toner particles.

If the content of the conductive titanium dioxide is less than approximately 0.1 wt %, the adding effect cannot be obtained. If the content of the conductive titanium dioxide exceeds approximately 2.0 wt %, the fusing property of the toner is lowered, the contamination of an image caused by isolation from the toner occurs, and the photosensitive medium is damaged. If the content of the hydrophobic titanium dioxide is less than approximately 0.1 wt %, the fluidity of the toner is lowered. If the content of the hydrophobic titanium dioxide exceeds approximately 2.0 wt %, the charging stability and fusing property of the toner are lowered.

| Embodiment<br>Composition of toner (based on a negative charge type toner) |
|---|
| Binder resin:<br>Polyester: 92 wt %<br>Acid value: 7 mg KOH/g<br>Coloring agent:<br>Carbon black: 5 wt %<br>Charge control agent (CCA):<br>Fe complex: 1 wt %<br>Release agent:<br>Low molecular weight polypropylene wax: 2 wt % |

Untreated toner having a particle size of 8 μm was obtained by a method of manufacturing toner by mixing the above components, and then, toner according to an embodiment of the present embodiment was manufactured by adding the following external additive.

| |
|---|
| Positive charge type large silica:<br>Average particle size: 30–50 nm<br>Charging amount per weight: +100–+300 μC/g<br>Content: 1.0 wt % with respect to untreated toner of 100 wt %<br>Negative charge type small silica:<br>Average particle size: 7–16 nm<br>Charging amount per weight: −400–−800 μC/g<br>Content: 1.0 wt % with respect to untreated toner of 100 wt %<br>Hydrophobic titanium dioxide:<br>Average particle size: 15–20 nm<br>Resistance: $10^5$–$10^{12}$ Ωcm<br>Content: 0.5 wt % with respect to untreated toner of 100 wt %<br>Conductive titanium dioxide:<br>Average particle size: 200–300 nm<br>Resistance: 1–$10^5$ Ωcm<br>Content: 0.5 wt % with respect to untreated toner of 100 wt %<br>Comparative example 1 |

The comparative example 1 was followed on the same composition and conditions as the composition and conditions of the above embodiment, except that a negative charge type large silica, instead of a positive charge type large silica, was externally added.

| Composition of toner (based on a negative charge type toner) |
|---|
| Binder resin:<br>Polyester: 92 wt %<br>Acid value: 7 mg KOH/g<br>Coloring agent:<br>Carbon black: 5 wt %<br>Charge control agent (CCA):<br>Fe complex: 1 wt %<br>Release agent:<br>Low molecular weight polypropylene wax: 2 wt % |

Untreated toner having a particle size of 8 μm was obtained by a method of manufacturing toner by mixing the above components, and then, toner according to the comparative example 1 was manufactured by adding the following external additive.

| |
|---|
| Negative charge type large silica:<br>Average particle size: 30–50 nm<br>Charging amount per weight: −100–−300 μC/g<br>Content: 1.0 wt % with respect to untreated toner of 100 wt %<br>Negative charge type small silica:<br>Average particle size: 7–16 nm<br>Charging amount per weight: −400–−800 μC/g<br>Content: 1.0 wt % with respect to untreated toner of 100 wt %<br>Hydrophobic titanium dioxide:<br>Average particle size: 15–20 nm<br>Resistance: $10^5$–$10^{12}$ Ωcm<br>Content: 0.5 wt % with respect to untreated toner of 100 wt %<br>Conductive titanium dioxide:<br>Average particle size: 200–300 nm<br>Resistance: 1–$10^5$ Ωcm<br>Content: 0.5 wt % with respect to untreated toner of 100 wt %<br>Comparative example 2 |

The comparative example 2 was followed on the same composition and conditions as the composition and conditions of the above comparative example 1, except that positive charge type polymer beads, instead of conductive titanium dioxide in the comparative example 1, was externally added.

| Composition of toner (based on negative charge type toner) |
|---|
| Binder resin: |
| Polyester: 92 wt % |
| Acid value: 7 mg KOH/g |
| Coloring agent: |
| Carbon black: 5 wt % |
| Charge control agent (CCA): |
| Fe complex: 1 wt % |
| Release agent: |
| Low molecular weight polypropylene wax: 2 wt % |

Untreated toner having a particle size of 8 μm was obtained by a method of manufacturing toner by mixing the above components, and then, toner according to the comparative example 2 was manufactured by adding the following external additive.

| |
|---|
| Negative charge type large silica: |
| Average particle size: 30–50 nm |
| Charging amount per weight: −100—300 μC/g |
| Content: 1.0 wt % with respect to untreated toner of 100 wt % |
| Negative charge type small silica: |
| Average particle size: 7–16 nm |
| Charging amount per weight: −400—800 μC/g |
| Content: 1.0 wt % with respect to untreated toner of 100 wt % |
| Hydrophobic titanium dioxide: |
| Average particie size: 15–20 nm |
| Resistance: $10^5$–$10^{12}$ Ωcm |
| Content: 0.5 wt % with respect to untreated toner of 100 wt % |
| Polymer beads: |
| Average particle size: 0.3–0.5 μm |
| Content: 0.5 wt % with respect to untreated toner of 100 wt % |
| Experimental example |

An image printed on a sheet of paper with each toner manufactured according to the above embodiment and the comparative examples 1 and 2 using a 20 ppm LBP printer was evaluated. The performance of each toner was evaluated by measuring an image density (I/D), background or fog (B/G) (contamination on a nonimage region), streak (vertical streak image contamination occurring when toner sticks to a toner layer regulation unit), and dot reproducibility. In this case, I/D was measured by the density of a solid pattern on the sheet of paper, and B/G was measured by the density of the nonimage region on a photosensitive medium using a densitometer, such as SpectroEye (manufactured by GRETAGMACBETH COMPANY), and the dot reproducibility and the streak were evaluated with the naked eye.

| Experimental conditions of a developing apparatus were as follows. |
|---|
| Surface potential (Vo) of photosensitive medium: −700 V |
| Potential (VL) of electrostatic latent image on photosensitive medium: −100 V |
| Voltage applied to developing roller: |
| Vp-p = 1.8 KV, frequency = 2.0 kHz, |
| Vdc = −500 V, duty ratio = 35% (square wave) |
| Development gap: 150–400 m |
| Developing roller: |
| (1) aluminum |
| roughness: Rz = 1–2.5 (after nickel plating) |

-continued

| Experimental conditions of a developing apparatus were as follows. |
|---|
| (2) rubber roller (NBR elastic rubber roller) |
| resistance: $1 \times 10^5$–$5 \times 10^5$ Ω |
| hardness: 50 |
| Toner: |
| charging amount per weight (Q/M): −5—−30 μC/g (on developing roller after going through toner layer regulation unit) |
| toner amount per area (M/A): 0.3–1.0 mg/cm$^2$ (on developing roller after going through toner layer regulation unit) |

The experimental result carried out under the above-described conditions is shown in Tables 1 to 3.

TABLE 1

Image evaluation result according to embodiment

| | Number of sheets | | | | | |
|---|---|---|---|---|---|---|
| Items | Initial stage | 2,000 | 4,000 | 6,000 | 8,000 | 10,000 |
| I/D | ○ | ○ | ○ | ○ | ○ | ○ |
| B/G | ○ | ○ | ○ | ○ | ○ | Δ |
| Dot reproducibility | ○ | ○ | ○ | ○ | ○ | Δ |
| Streak | ○ | ○ | ○ | ○ | ○ | ○ |

In Table 1, if an evaluation index I/D was equal to or greater than 1.3, the image was evaluated as "○". If the evaluation index I/D was between 1.1 and 1.3, the image was evaluated as "Δ". If the evaluation index I/D was less than 1.1, the image was evaluated as "X".

If an evaluation index B/G was equal to or less than 0.14, the image was evaluated as "○". If the evaluation index B/G was between 0.15 and 0.16, the image was evaluated as "ΔA". If the evaluation index I/D was equal to or greater than 0.17, the image was evaluated as "X".

The dot reproducibility and streak of the evaluation indices were evaluated with the naked eye. If the occurrence of the problems was not recognized, the image was evaluated as "○". If the problems occurred severely, the image was evaluated as "X".

The same evaluation method is applied to Tables 2 and 3.

TABLE 2

Image evaluation result according to comparative example 1

| | Number of sheets | | | | | |
|---|---|---|---|---|---|---|
| Items | Initial stage | 2,000 | 4,000 | 6,000 | 8,000 | 10,000 |
| I/D | ○ | ○ | ○ | ○ | ○ | ○ |
| B/G | ○ | ○ | ○ | Δ | X | X |
| Dot reproducibility | ○ | ○ | ○ | ○ | Δ | Δ |
| Streak | ○ | ○ | ○ | ○ | ○ | ○ |

TABLE 3

Image evaluation result according to comparative example 2

| | Number of sheets | | | | | |
|---|---|---|---|---|---|---|
| Items | Initial stage | 2,000 | 4,000 | 6,000 | 8,000 | 10,000 |
| I/D | ○ | ○ | ○ | ○ | ○ | ○ |
| B/G | ○ | ○ | ○ | ○ | Δ | Δ |

TABLE 3-continued

Image evaluation result according to comparative example 2

| Items | Number of sheets | | | | | |
|---|---|---|---|---|---|---|
| | Initial stage | 2,000 | 4,000 | 6,000 | 8,000 | 10,000 |
| Dot reproducibility | ○ | ○ | ○ | ○ | Δ | Δ |
| Streak | ○ | ○ | Δ | Δ | X | X |

Comparing Tables 1 to 3, when nonmagnetic one-component toner according to an embodiment of the present invention is used, the I/D, the B/G, the dot reproducibility, and the streak are improved. In particular, as the number of printing sheets increases, the improvement effect of the B/G and the streak are excellent.

As described above, when silica having a charge opposite to the toner particles, silica having the same charge as the toner particles, and titanium dioxide are added as an external additive, the I/D, the B/G, the dot reproducibility, and the streak are improved. In particular, as the number of printing sheets increases, the improvement effects of the B/G and the streak are excellent.

In addition, according to an embodiment of the present invention, the type, charge, size, and content of the external additive are adjusted, a toner amount M/A per unit area on the developing roller is uniformly maintained, and a toner thin layer having a weight equal to or less than approximately 1.0 mg/cm$^2$ is formed, such that a stable distribution of a charging amount, a high toner fluidity, and a developing property are maintained, contamination (fog) and dispersion of toner are prevented, and a developing efficiency and toner durability are improved, thus obtaining a high quality image.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A nonmagnetic one-component toner for an electrophotographic image forming apparatus, the toner comprising:

toner particles including a binder resin, and a coloring agent, a charging control agent (CCA), and a release agent which are contained in the binder resin; and an external additive added to the toner particles, wherein the external additive comprises:

approximately 0.1 to approximately 3.0 wt % of silica having a charge opposite to the toner particles;

approximately 0.1 to approximately 3.0 wt % of silica having a same charge as the toner particles; and approximately 0.1 to approximately 4.0 wt % of titanium dioxide, wherein the silica having the charge opposite to the toner particles is large silica having an average particle size of approximately 30-200 nm, and the silica having the same charge as the toner particles is small silica having an average particle size of approximately 5-20 nm, wherein titanium dioxide includes approximately 0.1-2.0 wt % of hydrophobic titanium dioxide and approximately 0.1-2.0 wt % of conductive titanium dioxide, and wherein an average particle size of the hydrophobic titanium dioxide is approximately 5-50 nm, and an average particle size of the conductive titanium dioxide is approximately 30-500 nm.

2. The toner of claim 1, wherein the weight ratio of the large silica to the small silica ranges from approximately 0.5:1 to approximately 3:1.

3. The toner of claim 1, wherein the external additive further includes approximately 0.1-3.0 wt % of large silica having the same charge as the toner particles and having an average particle size of approximately 30-200 nm.

4. The toner of claim 3, wherein the weight ratio of the large silica having the charge opposite to the toner particles and the same charge as the toner particles to the small silica having the same charge as the toner particles ranges from approximately 0.5:1 to approximately 3:1.

5. The toner of claim 3, wherein the weight ratio of silica having the same charge as the toner particles to silica having the charge opposite to the toner particles of the large silica ranges from approximately 1:1 to approximately 6:1.

6. The toner of claim 4, wherein the weight ratio of silica having the same charge as the toner particles to silica having a charge opposite to the toner particles of the large silica ranges from approximately 1:1 to approximately 6:1.

7. The toner of claim 1, wherein a resistance of the hydrophobic titanium dioxide is $10^5$-$10^{12}$ Ωcm, and a resistance of the conductive titanium dioxide ranges from approximately 1 to $10^5$ Ωcm.

8. The toner of claim 7, wherein an average particle size of the hydrophobic titanium dioxide is approximately 5-50 nm, and an average particle size of the conductive titanium dioxide is approximately 30-500 nm.

9. The toner of claim 1, wherein a charging amount per weight (Q/M) is an absolute value of approximately 5-30 μC/g.

10. The toner of claim 1, wherein an acid value of the binder resin is approximately 3-12 mg KOH/g.

11. A nonmagnetic one-component negative charge type toner for an electrophotographic image forming apparatus, the toner comprising:

toner particles including an approximately 92% polyester binder resin having an acid value of approximately 7 mg KOH/g, a coloring agent of approximately 5% carbon black, an approximately 1 wt % Fe complex as a charging control agent (CCA), and approximately 2 wt % of a release agent; and an external additive added to the toner particles, wherein the external additive comprises:

approximately 0.1 to approximately 3.0 wt % of silica having a charge opposite to the toner particles;

approximately 0.1 to approximately 3.0 wt % of silica having a same charge as the toner particles; and approximately 0.1 to approximately 4.0 wt % of titanium dioxide, and wherein the silica having the charge opposite to the toner particles is large silica having an average particle size of approximately 30-200 nm, and the silica having the same charge as the toner particles is small silica having an average particle size of approximately 5-20 nm, wherein titanium dioxide includes approximately 0.1-2.0 wt % of hydrophobic titanium dioxide and approximately 0.1-2.0 wt % of conductive titanium dioxide, and wherein an average particle size of the hydrophobic titanium dioxide is approximately 5-50 nm, and an average particle size of the conductive titanium dioxide is approximately 30-500 nm.

12. The toner of claim 1, wherein the binder resin is approximately 70-95 wt % with respect to the toner particles.

13. The toner of claim 1, wherein the coloring agent is carbon black, a primary particle size of the carbon black is approximately 15-70 nm, and a specific surface area of the carbon black is less than or equal to approximately 200 $m^2/g$.

14. The toner of claim 1, wherein the coloring agent is approximately 0.5 to 10 wt % with respect to the toner particles.

15. The toner of claim 1, wherein the CCA comprises an azo dye that includes chromium or salicylic acid compounds having at least one metal selected from a group consisting of chromium, iron and zinc.

16. The toner of claim 1, wherein the CCA comprises approximately 0.1-10 wt % with respect to the toner particles.

17. The toner of claim 1, wherein a weight of toner per unit area on a developing roller after going through a toner layer regulation unit of the electrophotographic image forming apparatus is in a range of approximately 0.3 to 1.0 $mg/cm^2$.

* * * * *

UNITED STATES PATENT AND TRADEMARK OFFICE

CERTIFICATE OF CORRECTION

PATENT NO. : 7,250,243 B2
APPLICATION NO. : 10/843394
DATED : July 31, 2007
INVENTOR(S) : Duck-hee Lee et al.

It is certified that error appears in the above-identified patent and that said Letters Patent is hereby corrected as shown below:

Title Page, Item (57) (Abstract), Line 1, change “nonmagentic” to --nonmagnetic--.

Signed and Sealed this

Eighteenth Day of December, 2007

JON W. DUDAS
*Director of the United States Patent and Trademark Office*